US005857304A

United States Patent [19]

Karten et al.

[11] Patent Number: 5,857,304

[45] Date of Patent: Jan. 12, 1999

[54] SLIDABLE LOCKING SYSTEM FOR DISENGAGEABLE PANELS

[75] Inventors: Stuart Karten, Venice; Michael J. Rocha, Los Angeles; Robert Blumenfeld, Sherman Oaks, all of Calif.

[73] Assignee: Abex Display Systems, Calif.

[21] Appl. No.: 834,989

[22] Filed: Apr. 7, 1997

[51] Int. Cl.[6] ..... E04B 2/82

[52] U.S. Cl. ..... 52/582.1; 52/582.2; 52/586.1; 52/285.4; 52/245; 403/325; 403/327; 403/DIG. 10

[58] Field of Search ..... 52/582.1, 582.2, 52/584.1, 586.1, 586.2, 585.1, 240, 243, 239, 285.4, 277, 81.4, 245, 246, 286, 592.6; 403/325, 326, 327, DIG. 10, 331

[56] References Cited

U.S. PATENT DOCUMENTS

| | | | |
|---|---|---|---|
| 324,671 | 8/1885 | Drake | 403/325 X |
| 1,881,681 | 10/1932 | Klumpp | 403/327 X |
| 3,332,182 | 7/1967 | Mark | 52/584.1 X |
| 3,778,954 | 12/1973 | Messerole | 52/582.1 X |
| 3,873,224 | 3/1975 | Letzel et al. . | |
| 4,395,856 | 8/1983 | Smith et al. . | |
| 4,408,430 | 10/1983 | Wangler et al. . | |
| 4,635,327 | 1/1987 | Netznik . | |
| 4,679,368 | 7/1987 | Pettinga et al. . | |
| 4,689,929 | 9/1987 | Wright . | |
| 4,778,487 | 10/1988 | Chenel | 403/325 X |
| 5,004,371 | 4/1991 | Sorensen . | |
| 5,101,606 | 4/1992 | Meru | 52/282.3 |
| 5,125,193 | 6/1992 | Beaulieu | 52/582.2 X |
| 5,179,810 | 1/1993 | Gename et al. | 52/240 |
| 5,242,241 | 9/1993 | Nelson . | |
| 5,581,963 | 12/1996 | Snair et al. . | |
| 5,651,150 | 7/1997 | Kanitzer et al. | 403/327 X |
| 5,687,859 | 11/1997 | Miller | 52/584.1 X |
| 5,689,926 | 11/1997 | Nichols | 52/239 X |

FOREIGN PATENT DOCUMENTS

| | | | |
|---|---|---|---|
| 657506 | 1/1929 | France | 403/327 |
| 2189566 | 10/1987 | United Kingdom | 403/327 |

*Primary Examiner*—Carl D. Friedman
*Assistant Examiner*—Laura A. Callo
*Attorney, Agent, or Firm*—Raymond Sun

[57] ABSTRACT

A system is disclosed for connecting a first panel to a second panel in a manner which aligns the first and second panels at the same vertical level with respect to each other. The first panel has a female connecting member provided along its vertical edge, and a channel disposed transverse to the vertical edge. The second panel has a male connecting member provided along its vertical edge, and a slot provided in the male connecting member. A sliding pin block is retained for sliding movement inside the channel of the first panel, the sliding pin block having a pin normally biased to extend through the female connecting member. The pin is fitted inside the slot of the male connecting member when the first and second panels are connected along their vertical edges to align the first and second panels at the same vertical level with respect to each other.

20 Claims, 8 Drawing Sheets

SLIDABLE LOCKING SYSTEM FOR DISENGAGEABLE PANELS

BACKGROUND OF THE INVENTION

1. Field of the Invention

The present invention relates to disengageable panels for use in assembling modular display systems, and in particular, to a slidable locking system for securely connecting adjacent panels so that the connected panels are vertically aligned.

2. Description of the Prior Art

Separate and disengageable panels have been provided for assembling modular display systems that are used for advertising and presentations at industrial and trade shows. These panels are joined together to form walls, shelvings, counters, cabinets and/or projection screens.

Connectors and fasteners have been provided for joining these separate and disengageable panels to form the desired structures and configurations. Previous connectors and fasteners have suffered from the drawback that the structural elements of these connectors and fasteners have been exposed. Exposed structural elements are undesirable because they are aesthetically displeasing and can sometimes be an obstruction or render certain areas of the panels unuseable.

One attempt to address this drawback was provided in U.S. Pat. No. 4,689,929 to Wright. Wright provides a fastening system which is concealed within the panel frame. A male member includes a matrix which defines at least one linear channel and at least a part of a linear shaft internal to the matrix. A female member also includes a matrix which defines part of a panel edge. The matrix of the male member is slid into the matrix of the female member to form a connection in which the structural elements of the male and female members are concealed.

One drawback associated with such male-female slidable fastening systems is encountered when the panels connected by these systems are placed on an uneven surface. For example, if adjacent connected panels are placed on an uneven surface, these panels will not be vertically aligned. In other words, one panel will be higher than the other.

Thus, there remains a need for a fastening or connecting system for use in securely connecting disengageable panels, which prevents vertical displacement of one panel with respect to an adjacent panel, which is concealed, which is simple in construction, and which is easy to use.

SUMMARY OF THE DISCLOSURE

In order to accomplish the objects of the present invention, there is provided a system for connecting a first panel to a second panel in a manner which aligns the first and second panels at the same vertical level with respect to each other. The first panel has a female connecting member provided along its vertical edge, and a channel disposed transverse to the vertical edge. The second panel has a male connecting member provided along its vertical edge, and a slot provided in the male connecting member. A sliding pin block is retained for sliding movement inside the channel of the first panel, the sliding pin block having a pin normally biased to extend through the female connecting member. The pin is fitted inside the slot of the male connecting member when the first and second panels are connected along their vertical edges to align the first and second panels at the same vertical level with respect to each other.

In accordance with the present invention, the female connecting member has a linear channel extending along the vertical edge of the first panel, and the male connecting member has a leg extending from the vertical edge of the second panel. The leg has a front surface facing the first panel, and the slot is provided on the front surface. To achieve the connection of the first and second panels according to the present invention, the leg is slidingly engaged in the linear channel of the female connecting member to connect the second panel to the first panel, with the pin of the sliding pin block extending through the linear channel of the female connecting member and into the slot. According to one method according to the present invention, the sliding pin block may pressed rearwardly to allow the leg to slide into the linear channel of the female connecting member, and the sliding pin block is biased back into the linear channel and the pin guided into the slot when the pin is aligned at the same vertical level with the slot. Alternatively, a ramped surface provided on the leg below the front surface engages the pin and presses the pin and sliding pin block rearwardly as the leg slides downwardly in the linear channel, with the sliding pin block biased back into the linear channel and the pin guided into the slot when the pin is aligned at the same vertical level with the slot.

According one embodiment of the present invention, the locking system can be used with curved panels. According to this embodiment, the channel of the first panel, and the first panel, are both curved. The sliding pin block includes a base section having a first side and a second side, a first pair of corners on the first side defining a first longitudinal recess along the first side between the first pair of corners, and a second pair of corners on the second side defining a second longitudinal recess along the second side between the second pair of corners. The sliding pin block further includes a narrow upper section extending upwardly from the base section. Only the four corners of the base section contact the inner walls of the channel when the base section slides inside the channel. The minimal contact between the base section and the channel allows the sliding pin block to conform to the curved nature of the channel and can therefore be easily slid inside a channel having a significant degree of curvature. In addition, the slot is horizontally elongated to allow the pin to enter the slot at a wider range of angles to accomodate the entry of the pin from channels having different degrees of curvature.

Thus, the system according to the present invention provides a biased sliding pin mechanism which securely maintains two adjacent connected panels at the same vertical level. The biased sliding pin mechanism can be used with straight and curved panels. In addition, the elements of the biased sliding pin mechanism are concealed inside the connection, and the male and female connecting members are also concealed after the adjacent panels have been connected. The biased sliding pin mechanism is also easy to use, since it is adapted for slide-fit engagement when the male and female connecting mechanisms are connected. The elements that make up the biased sliding pin mechanism are also few in number, thereby simplifying the complexity and structure of the connecting mechanism.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

Figure 1:
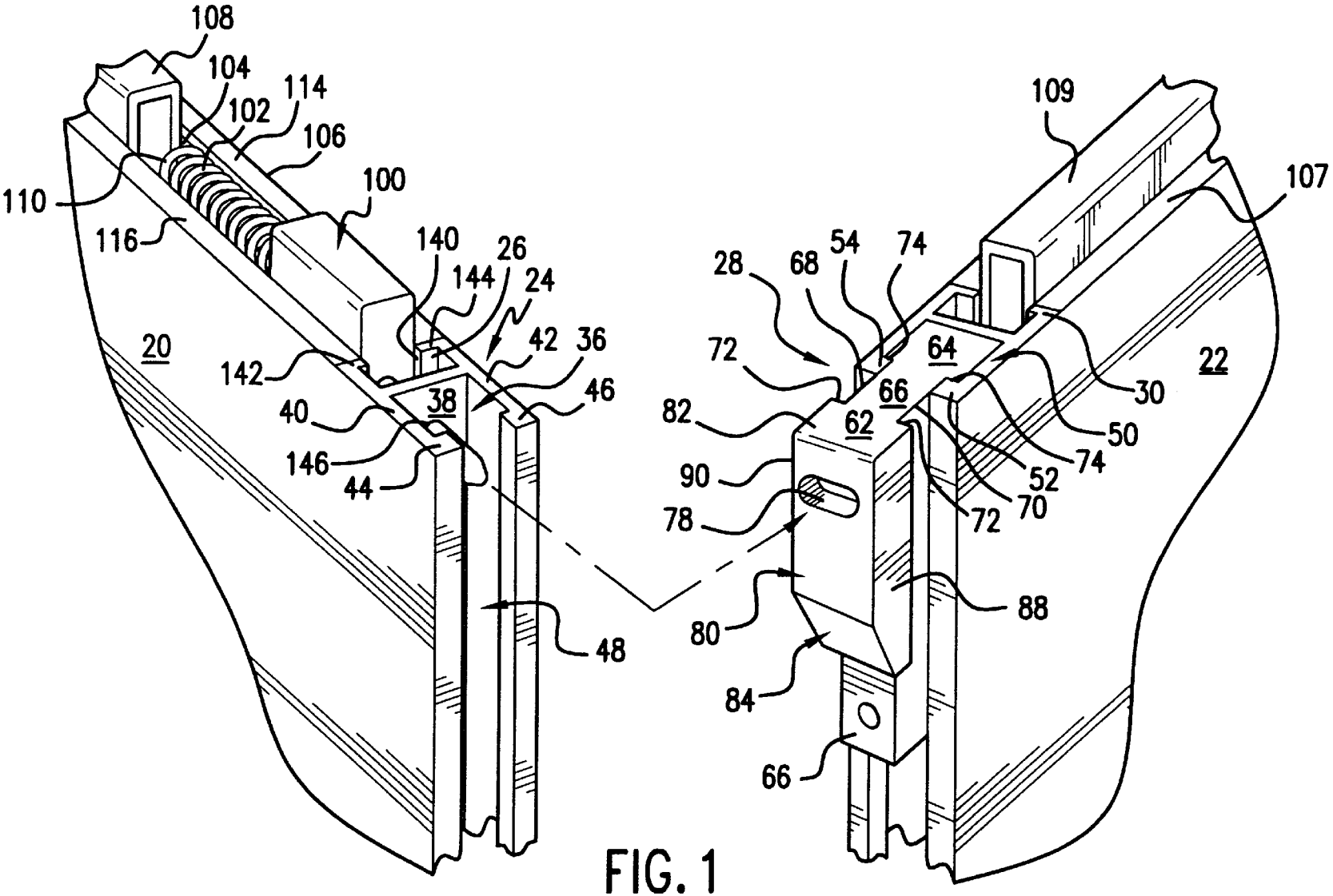
FIG. 1 is an exploded perspective view of two adjacent panels provided with a slidable locking system according to the present invention.
Figure 2:
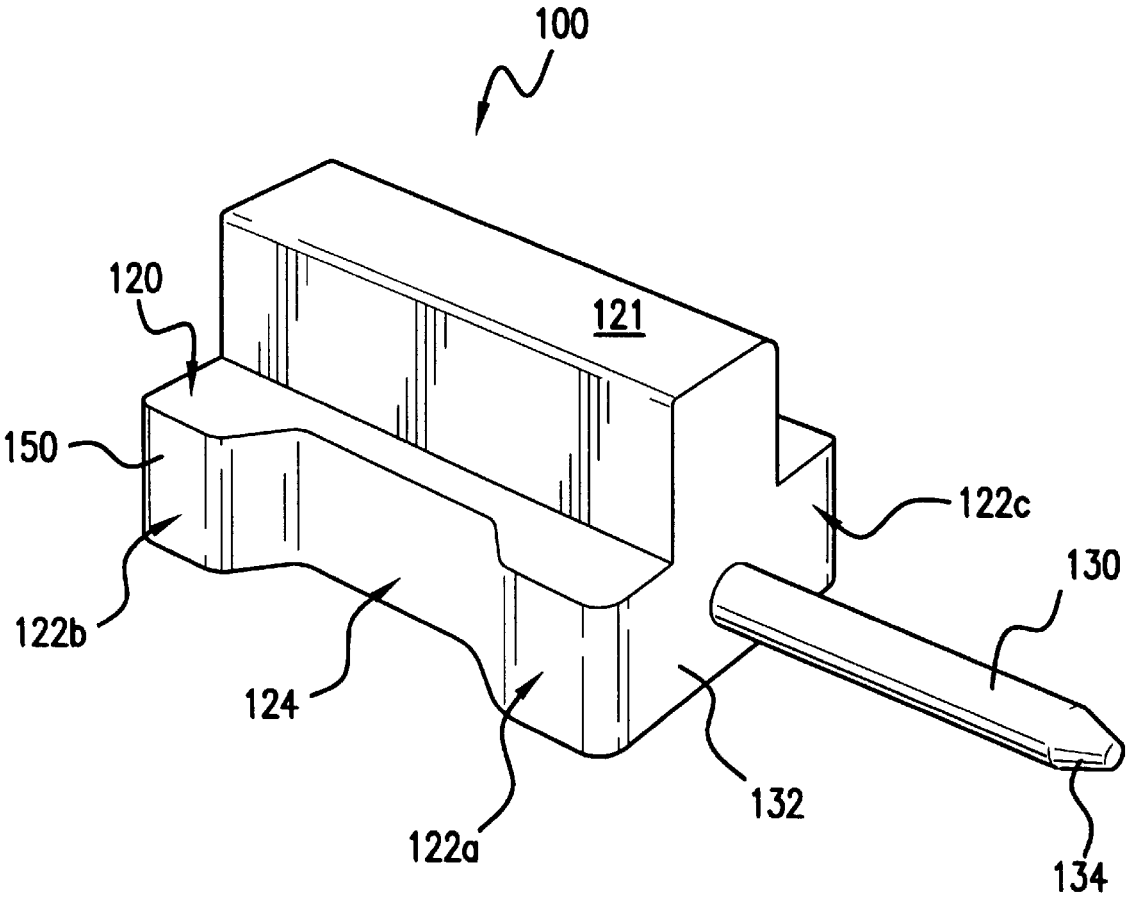
FIG. 2 is a perspective view of a sliding pin block of the slidable locking system of FIG. 1.

A first embodiment of a panel system according to the present invention is illustrated in FIGS. 1–5. Referring to FIG. 1, the panel system includes a first panel 20 and a second panel 22. The first panel 20 has a female connecting mechanism 24 provided along its vertical edge 26 and which is adapted to engage a male connecting mechanism 28 provided along the vertical edge 30 of the second panel 22.

Figure 3:
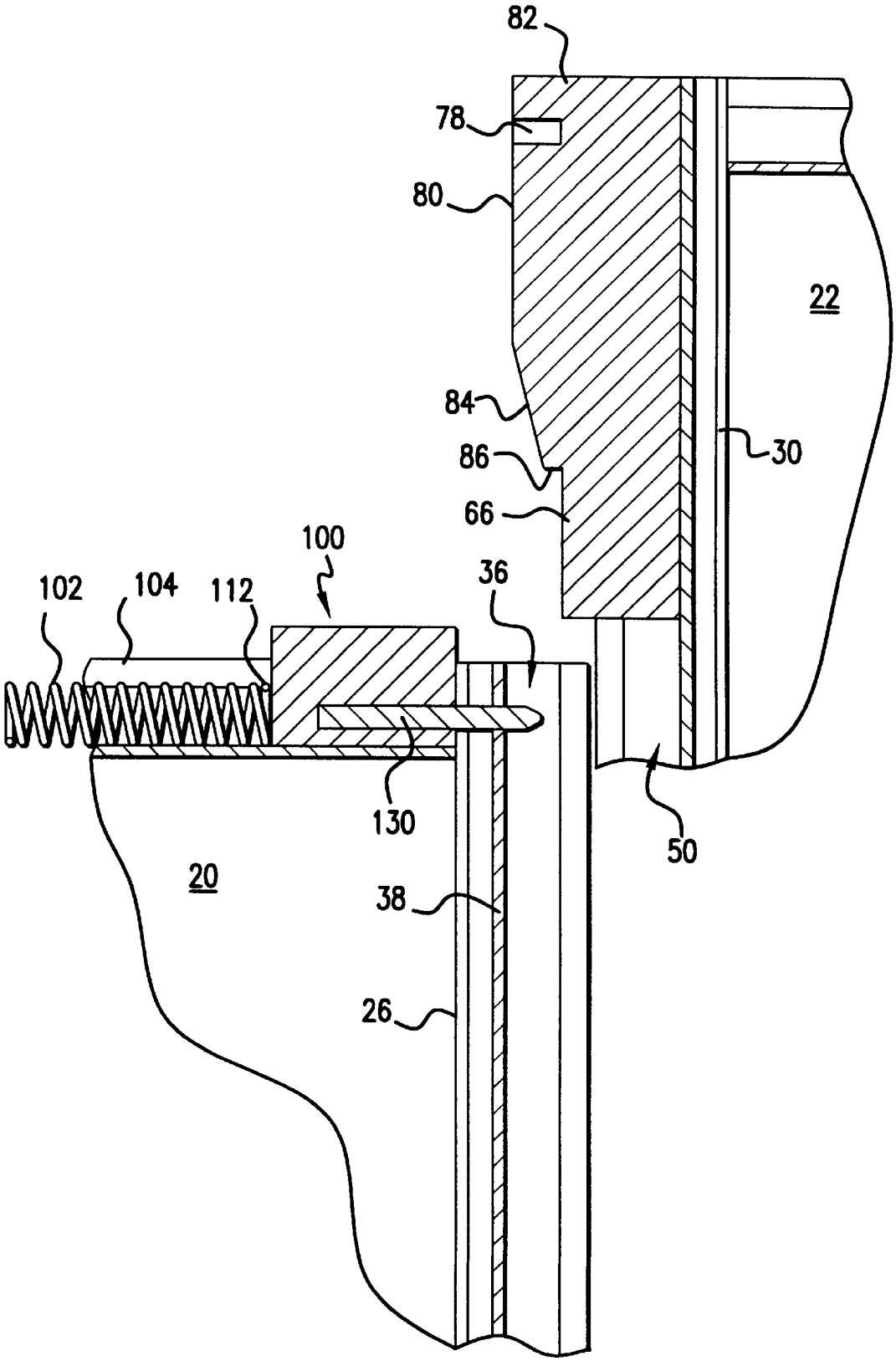
FIG. 3 is an exploded cross-sectional view of the two adjacent panels of FIG. 1 illustrating how they are aligned prior to connections
Figure 5A:
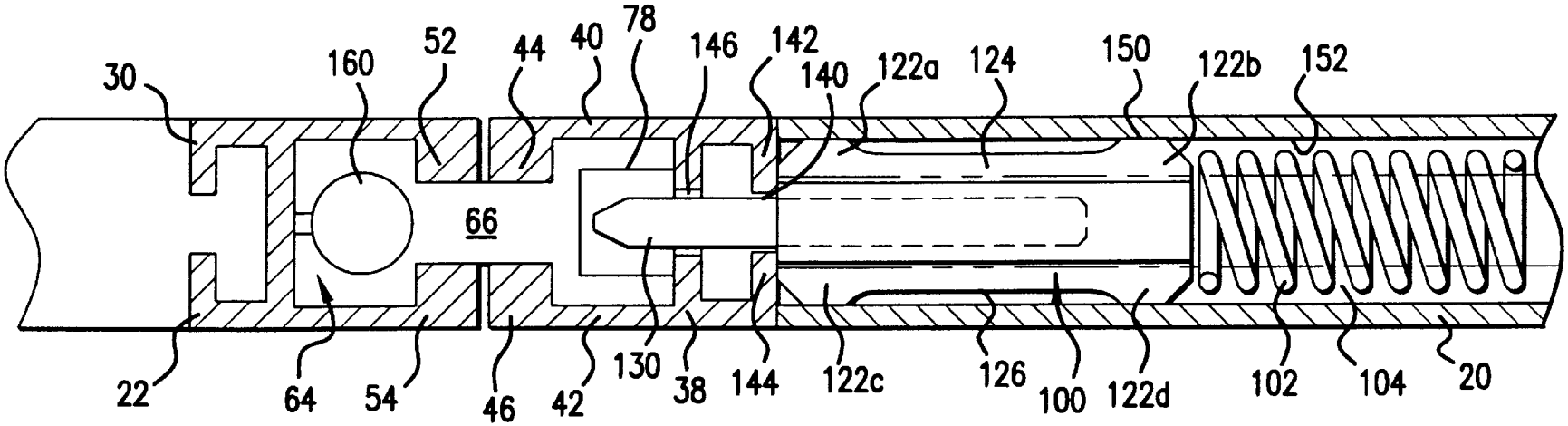
FIGS. 5A–5C are top plan views of various adjacent panels illustrating how they are aligned after they have been connected.

Referring to FIGS. 1, 3 and 5A, the female connecting mechanism 24 forms a linear channel 36 extending along the vertical edge 26. The linear channel 36 is defined by a generally U-shaped wall having a bottom wall 38, two side walls 40 and 42 extending from the bottom wall 38, and two projections 44 and 46 extending inwardly from the top of the side walls 40 and 42, respectively. A longitudinal slit 48 is defined between the projections 44 and 46.

A linear channel 50 having a configuration similar to that of linear channel 36 is provided along the vertical edge 30 of the second panel 22. The linear channel 50 is also defined by a generally U-shaped wall having two projections 52 and 54. The male connecting mechanism 28 is a generally H-shaped block element having a first leg 62 and a second leg 64 connected by a mid-section 66. A first groove 68 and a second groove 70 are defined on either side of the mid-section 66 between the inner edges 72 and 74 of the legs 62 and 64, respectively. The second leg 64 is attached to an upper part of the linear channel 50 by a set screw, for example, or by other similar and conventional attachment mechanisms. As a result, the first leg 62 and the mid-section 66 extend outside the linear channel 50 and is adapted for sliding engagement with the linear channel 36 of the female connecting mechanism 24.

The first leg 62 has an elongated slot 78 provided in a generally flat front surface 80. The slot 78 is preferably elongated from one side to the other (i.e., in a horizontal direction), and is not elongated vertically. The front surface 80 extends from the top surface 82 of the generally H-shaped block element to a ramped surface 84. The ramped surface 84 extends downwardly at an inward angle towards the second panel 22 until it reaches a horizontal bottom edge 86 of the first leg 62, which terminates at the mid-section 66. The first leg 62 also includes side surfaces 88 and 90 on either side of the leg 62 between the front surface 80 and the inner edges 72.

The first and second panels 20 and 22 are connected by sliding the first leg 62 of the male connecting mechanism 28 into the linear channel 36 of the female connecting mechanism 24, with the mid-section 66 held in the slit 48 between the projections 44 and 46. When connected, the first leg 62 will be retained inside linear channel 36 with its inner edges 72 adjacent the projections 44 and 46, and with the side surfaces 88 and 90 adjacent the side walls 40 and 42, respectively, of the female connecting mechanism 24. Unfortunately, if the surface that supports the panels 20 and 22 is not even, one panel 20 or 22 may be disposed at a higher vertical level with respect to the other panel 22 or 20.

The present invention provides a biased sliding pin mechanism which secures the panels 20 and 22 at the same vertical level after they have been connected by the female and male connecting mechanisms 24 and 28. The sliding pin mechanism includes a sliding pin block 100 (see also FIG. 2) and a spring 102 that are slidably retained inside a groove or channel 104 provided along the upper edge 106 of the first panel 20. An insert 108 is either integrally connected to, or snap-fitted inside, the groove 104. The spring 102 is retained in the groove 104 by having one end 110 adjacent the insert 108 and the opposing end 112 adjacent the rear of sliding pin block 100. The insert 108, spring 102 and sliding pin block 100 can be connected to each other, or can be positioned inside the groove 104 in a tight-fit arrangement without being physically connected to each other. The groove 104 has upper lips 114 and 116 that retain the sliding pin block 100, spring 102 and insert 108 inside the groove 104.

Figure 6:
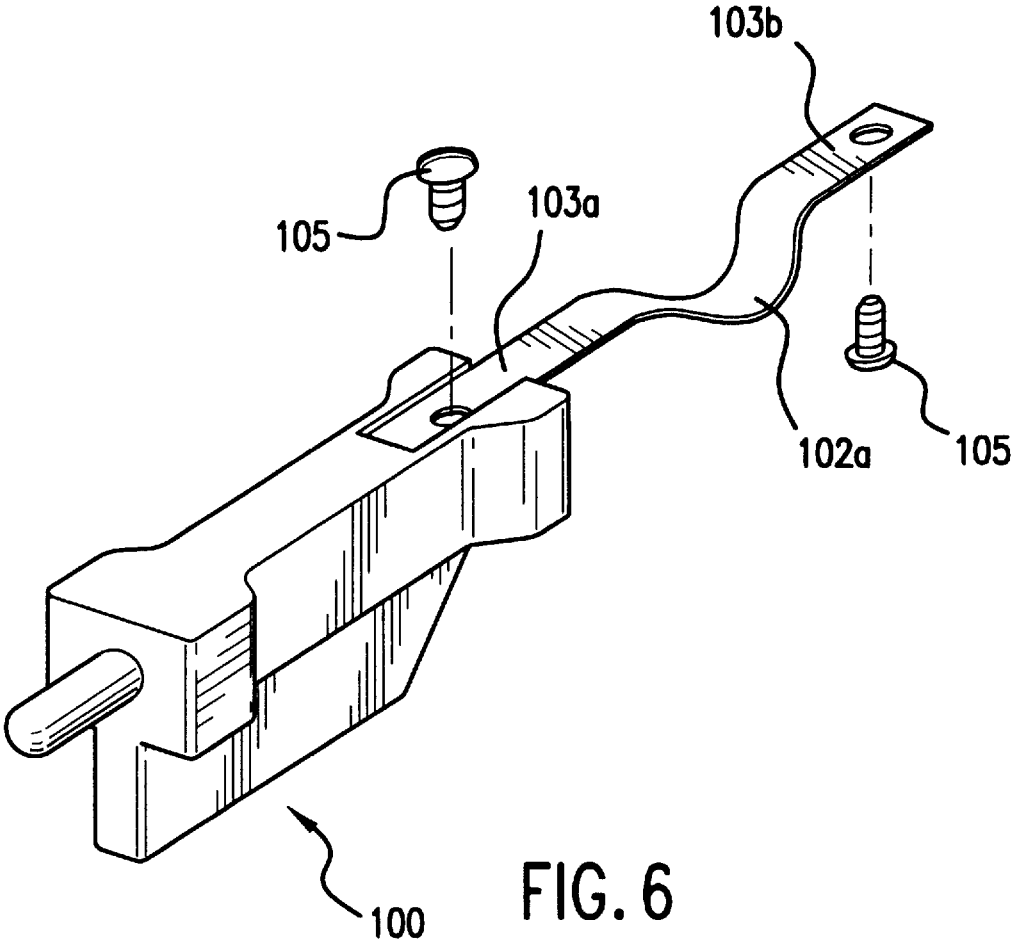
FIG. 6 is, a perspective view of the sliding pin block of FIG. 2 secured to a leaf spring.

The insert 108 may be an extruded rigid vinyl or other similar material, and functions to locate and align the panel 20 with the bottom of another panel that may be detachably connected above panel 20. In this regard, the panel 22 is also provided with an insert 109 along its upper edge 107 to locate and align the panel 22 with another panel that may be detachably connected above panel 22. The inserts 108 and 109 additionally function to prevent light from passing through the seams between the panels. The spring 102 may be a coiled spring or other similar conventional mechanism which serves to bias the sliding pin block 100 away from the insert 108. FIG. 6 illustrates another example, in which a leaf spring 102*a* has one end 103*a* attached, for example, by a screw 105, to the bottom of the sliding pin block 100, and an opposite end 103*b* attached, for example, by another screw 105, to the groove 104.

The sliding pin block 100 has a base section 120 and a narrow upper section 121. The base section 120 has a generally rectangular configuration with four corners 122*a*, 122*b*, 122*c* and 122*d* defining two longitudinal recesses 124 and 126 between each pair of corners 122*a*, 122*b* and 122*c*, 122*d*, respectively, along each longitudinal side of the base section 120. The narrow upper section 121 extends upwardly from the base section 120 and has a generally rectangular configuration. The narrow upper section 121 preferably has a width that is less than the width between the lips 114 and 116 of the groove 104, and preferably has a width which is about the same as the width of insert 108 so that the narrow upper section 121 can be also be aligned with the bottom of another panel to be detachably connected on top of the panel 20. The narrow upper section 121 provides two functions. First, it functions as a gripper, as explained below. Second, it acts as a guiding mechanism to ensure that the sliding pin mechanism 100 is centered in the groove 104 as it slides inside the groove 104. An elongated pin 130 extends from the front end 132 of the base section 120. The pin 130 has a tapered tip 134.

The base section 120 of the sliding pin block 100 is positioned in the groove 104 so that the lips 114 and 116 of the groove 104 overlie the corners 122*a–d* to retain the base section 120 inside the groove 104. A slit 140 is provided along the vertical edge 26 of the first panel 20 so that the vertical edge 26 defines two projections 142 and 144. The sliding pin block 100 is normally biased by the spring 102 away from the insert 108 so that its front end 132 abuts the two projections 142 and 144 of the vertical edge 26 of the first panel 20. The pin 130 extends through the slit 140 and an aperture 146 provided in the bottom wall 38 of the female connecting mechanism 24, and extends into the linear channel 36.

Figure 4:
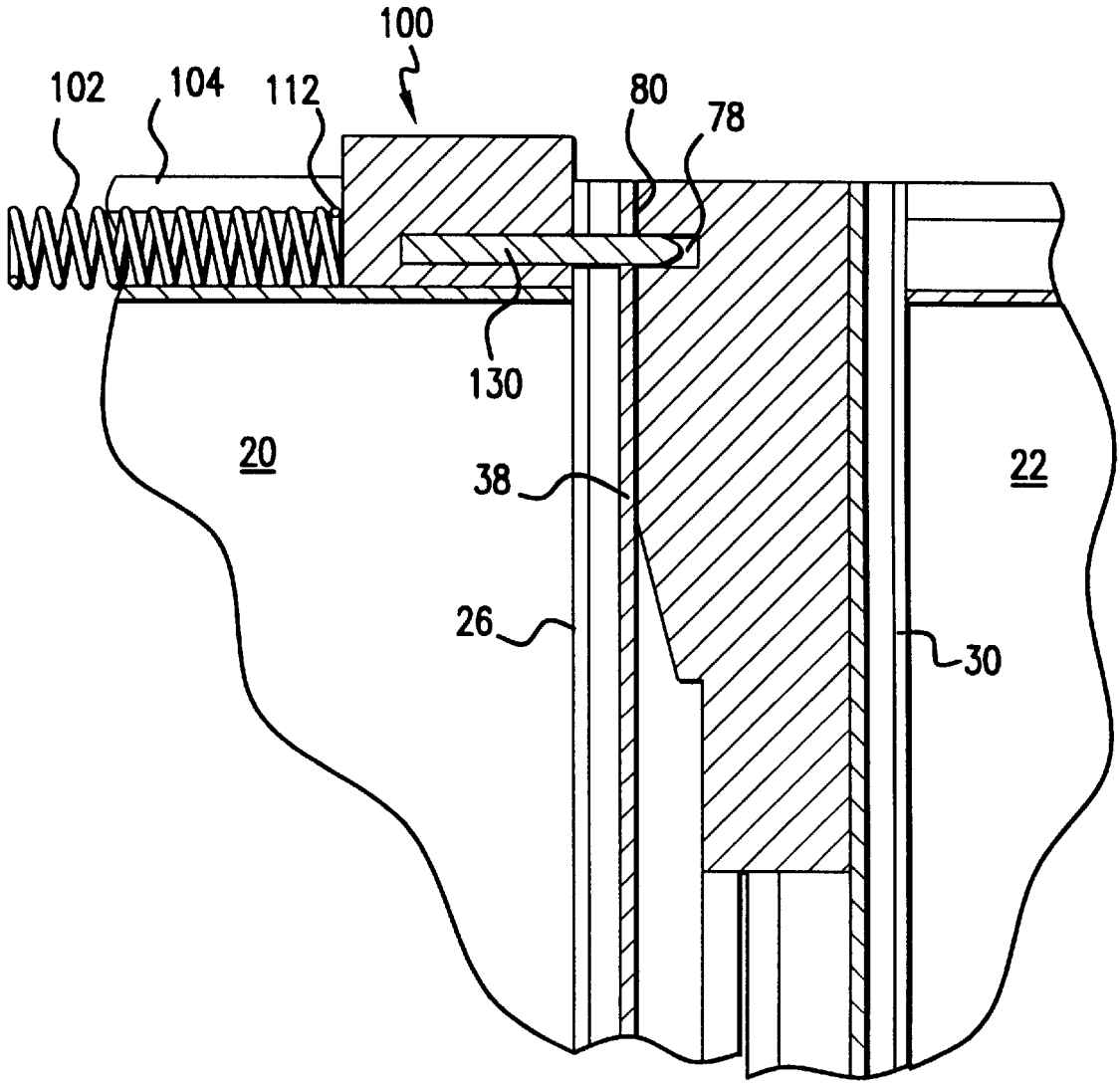
FIG. 4 is an exploded cross-sectional view of the two adjacent panels of FIG. 1 illustrating how they are aligned after they have been connected.

The operation of the sliding pin block 100 will be better understood with reference to FIGS. 3–5. Referring to FIG. 3, to connect the panels 20 and 22, the second panel 22 is raised above the first panel 20 so that the first leg 62 of the male connecting mechanism 28 can be slid into the linear channel 36 of the female connecting mechanism 24. As the first leg 62 slides down the linear channel 36, the tip 134 of the pin 130 contacts the ramped surface 84, which gradually presses the pin 130 backwards while overcoming the bias of the spring 102. When the flat front surface 80 enters the linear channel 36, the pin 130 no longer extends into the linear channel 36, being pushed back by the flat front surface 80 so that the tip 134 is now biased by the spring 102 against the flat front surface 80. As the flat front surface 80 slides down the linear channel 36, the elongated slot 78 will eventually be aligned with the pin 130. At this time, the bias of the spring 102 will push the pin 130 into the slot 78. See FIG. 4. This produces a secure connection of the panels 20 and 22 at the vertical level of the pin 130 and slot 78 engagement so as to prevent the panels 20 and 22 from being vertically mis-aligned with respect to each other.

Alternatively, the user can use his or her fingers to grip the narrow upper section 121 or press its front surface 132 backwardly while the first leg 62 is being slid into the linear channel 36. It is also possible to omit the ramped surface 84 of the first leg 62, so that the flat front surface 80 connects with the horizontal bottom edge 86. By omitting the ramped surface 84, the user must press the sliding pin block 100 backwards (via the narrow upper section 121) when the first leg 62 is being slid into the linear channel 36. Otherwise, the bottom edge 86 will abut against the top of pin 130 and prevent the pin 130 from aligning with the slot 78.

The structure of the sliding pin block 100 further combines with the elongated nature of slot 78 to allow the present invention to be used with curved panels. First, the provision of the four corners 122*a–d* and the longitudinal recesses 124 and 126 allow the sliding pin block 100 to be slid along curved grooves 104. By cutting out the longitudinal recesses 124 and 126, only the outer surfaces of the 150 of the four corners 122*a–d* contact the inner surface 152 of the groove 104 during the sliding motion of the sliding pin block 100 inside groove 104. Thus, by minimizing the surface area of the base section 120 that contacts the groove 104 during sliding motion thereof, the base section 120 can be adapted to conform to the curved nature of the groove 104 and can therefore be easily slid inside a curved groove 104. Otherwise, if the outer surface along the entire longitudinal sides of the base section 120 were to contact the inner surface 152 of the groove 104 during sliding motion (i.e., the sides of the base section 120 are not recessed at 124 and 126), it would be difficult to adapt the sliding pin block 100 to conform to the curvature of the groove 104, and in particular, grooves 104 having a significant degree of curvature. Second, since a pin 130 traveling along a curved groove 104 would be entering the linear channel 36 at an angle, the elongated or widened nature of the slot 78 allows the tapered tip 134 of the pin 130 to enter the slot 78 at a wider range of angles to accomodate the entry of the pin 130 from grooves 104 having different degrees of curvature.

Figure 5B:
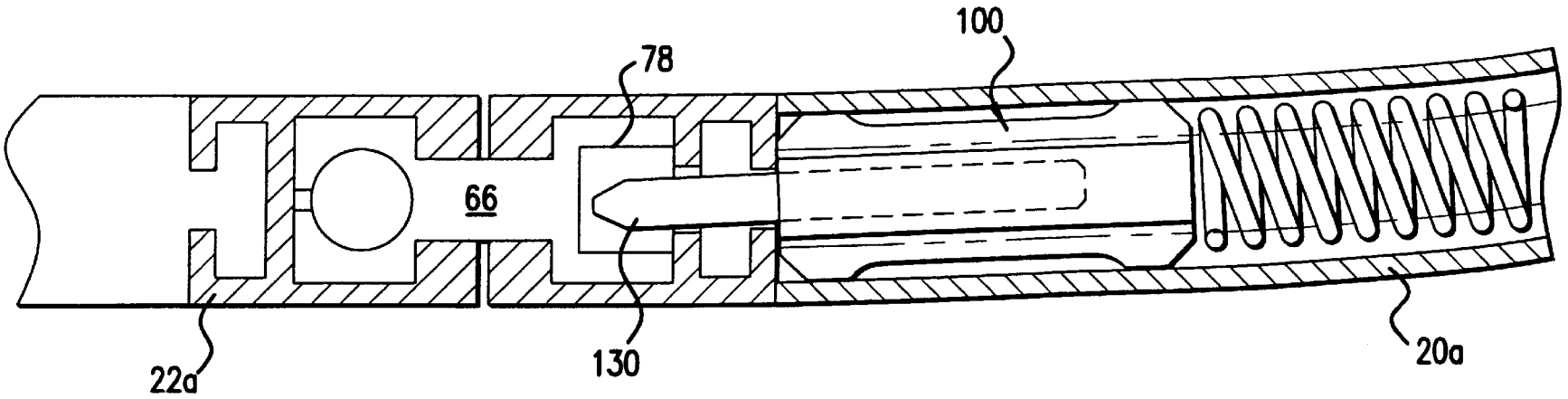
Figure 5C:
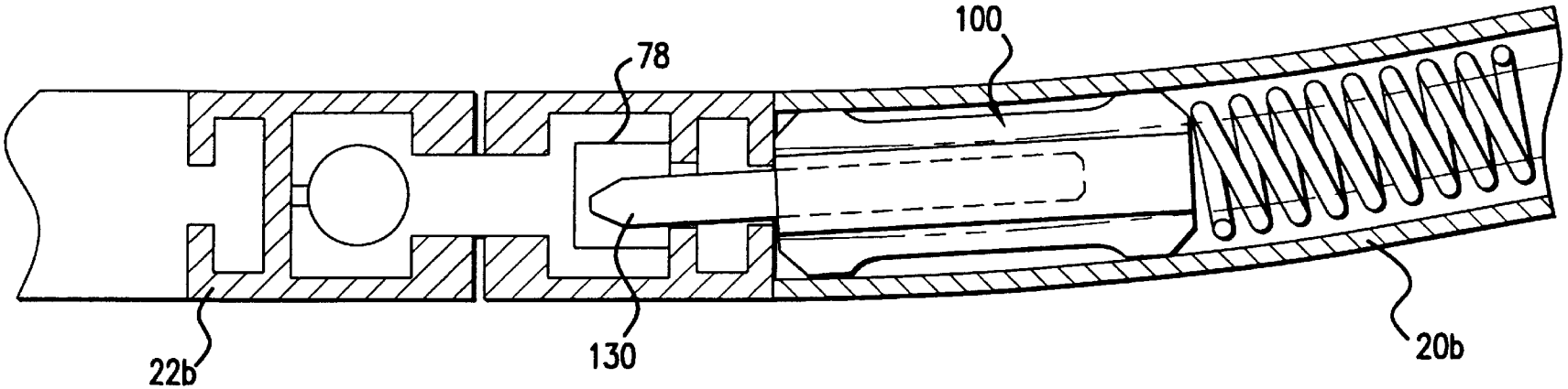

These principles are best illustrated by referring to FIGS. 5A–5C. FIG. 5A illustrates two straight panels 20 and 22, where the sliding pin block 100 can be slid back and forth along the groove 104 and easily aligned for insertion into the slot 78 at a central portion of the slot 78. FIG. 5B illustrates a slightly curved first panel 20*a*, with the pin 130 entering the slot 78 at an angle and slightly offset from the center of slot 78. FIG. 5C illustrates a first panel 20*b* with a degree of curvature that is greater than that of first panel 20*a* in FIG. 5B, with the pin 130 entering the slot 78 at another angle and offset from the center of slot 78 to the point where the tapered tip 134 almost contacts an inside wall of the slot 78. The tip 134 is tapered to facilitate a smoother entry of the tip 134 into the slot 78 at the tapered regions of the tip 134.

To facilitate the above-described method of use, the elongated slot 78 preferably has a height which is only slightly larger than the diameter of the pin 130, and preferably has a width or elongation which ranges from 1.5 to 2 times the diameter of the pin 130. In addition, the width of the narrow upper section 121 is preferably smaller than the width between the lips 114 and 116 of the groove 104 so that the narrow upper section 121 will not impede sliding movement of the sliding pin block 100 along curved grooves 104. If the width of the narrow upper section 121 is too large, longitudinal recesses, such as longitudinal recesses 124 and 126, will also need to be provided along the narrow upper section 121 to facilitate use with grooves 104 having a significant degree of curvature.

Figure 7:
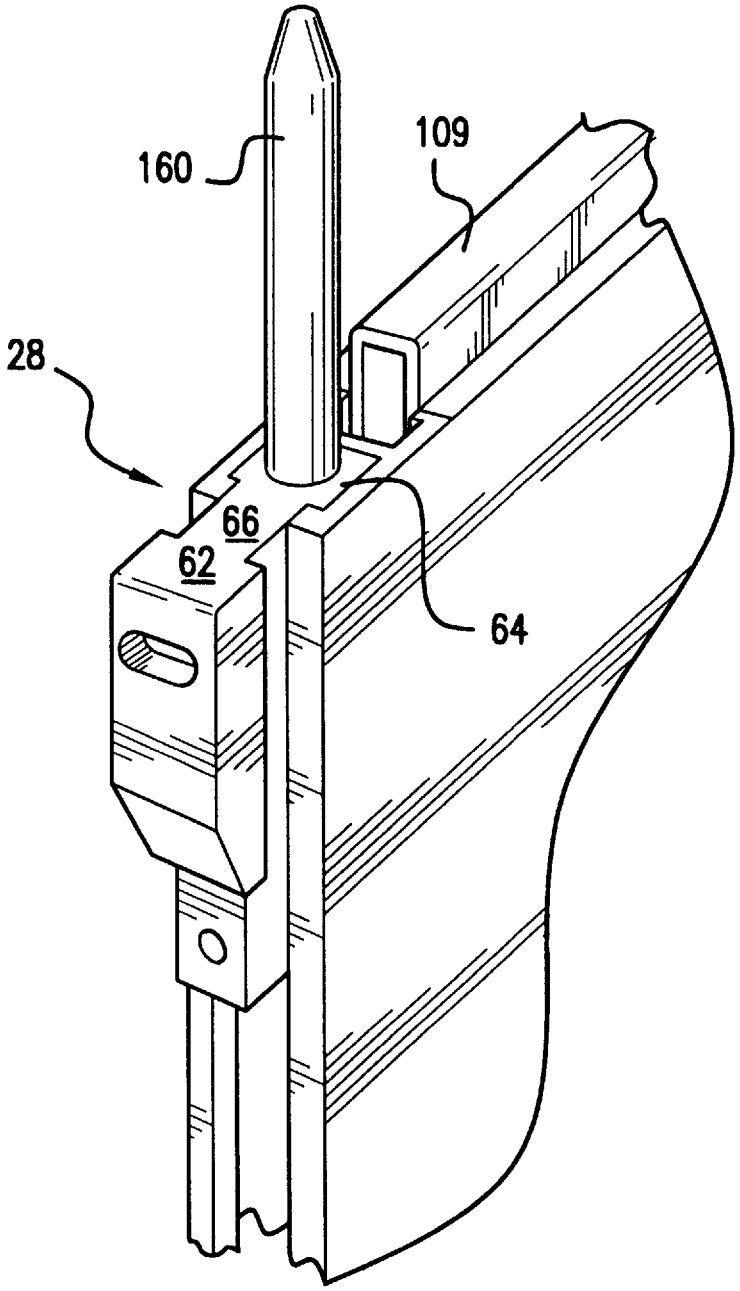
FIG. 7 is a perspective view of one of the panels of FIG. 1 provided with a post for alignment with another panel.

Referring to FIG. 7, the panel 22 may be provided with a post 160 that extends vertically from the top surface 82 of the second leg 64 of the generally H-shaped block element. The post 160 is used to align the panel 22 with another panel to be connected above the panel 22. The post 160 is adapted to be inserted into a slot or channel provided at the bottom of the other panel. If panel 22 is intended to the highest panel in the display system, then post 160 can be omitted.

To disassemble the panels 20 and 22, the user merely presses the narrowed upper section 121, and therefore the sliding pin block 100, rearwardly against the bias of the spring 102, so as to remove the pin 130 from the slot 78. The panels 20 and 22 may then be slid upwardly or downwardly with respect to each other and removed.

Although the slidable locking system of the present invention has been described in connection with the female and male connecting mechanisms 24 and 28 described above, those skilled in the art will appreciate that other male-female connecting or fastening mechanisms can be used without departing from the spirit and scope of the present invention. In this regard, any of the male-female matrix combinations shown and described in U.S. Pat. No. 4,689,929 to Wright can be used, and the entire disclosure of this patent is incorporated by reference as though fully set forth herein.

Thus, the slidable locking system according to the present invention provides a biased sliding pin mechanism which securely maintains two adjacent connected panels at the same vertical level. The biased sliding pin mechanism can be used with straight and curved panels. In addition, the elements of the biased sliding pin mechanism (i.e., the spring 102 and sliding pin block 100) are concealed inside the groove 104, and the male and female connecting mechanisms 28 and 24 are also concealed after the adjacent panels 20 and 22 have been connected. The biased sliding pin mechanism is also easy to use, since it is adapted for slide-fit engagement when the male and female connecting mechanisms 28 and 24 are connected. The elements that make up the biased sliding pin mechanism are also few in number, thereby simplifying the complexity and structure of the connecting mechanism.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. In combination:

a first panel comprising a vertical edge, a female connecting member provided along the vertical edge, and a curved channel disposed transverse to the vertical edge;

a second panel comprising a vertical edge and a male connecting member provided along the vertical edge of the second panel, the male connecting member having a front surface facing the first panel, and a slot provided on the front surface and having a width;

a slidable locking system for use in connecting the first and second panels, comprising a sliding pin block retained for sliding movement inside the channel of the first panel, the sliding pin block comprising a pin normally biased to extend through the female connecting member, the pin having a width; and wherein the pin is fitted inside the slot of the male connecting member when the first and second panels are connected along their vertical edges, the pin operating to align the first and second panels at the same vertical level with respect to each other; and wherein the slot is horizontally elongated such that its width is greater than the width of the pin.

2. The combination of claim 1, wherein the female connecting member comprises a linear channel extending along the vertical edge of the first panel, and the male connecting member comprises a leg extending from the vertical edge of the second panel, the leg having a front surface facing the first panel, and wherein the slot is provided on the front surface.

3. The combination of claim 2, wherein the leg is slidingly engaged in the linear channel of the female connecting member to connect the second panel to the first panel, and wherein the pin of the sliding pin block extends through the linear channel of the female connecting member and into the slot.

4. The combination of claim 3, wherein the sliding pin block is pressed rearwardly as the leg is slid into the linear channel of the female connecting member, and the sliding pin block is biased back into the linear channel and the pin guided into the slot when the pin is aligned at the same vertical level with the slot.

5. The combination of claim 4, wherein the leg comprises a ramped surface below the front surface, and wherein the ramped surface engages the pin and presses the pin and sliding pin block rearwardly as the leg slides downwardly in the linear channel.

6. In combination:

a first panel comprising a vertical edge, a female connecting member provided along the vertical edge, and a channel disposed transverse to the vertical edge;

a second panel comprising a vertical edge and a male connecting member provided along the vertical edge of the second panel, the male connecting member having a slot;

a slidable locking system for use in connecting the first and second panels, comprising a sliding pin block retained for sliding movement inside the channel of the first panel, the sliding pin block comprising a pin normally biased to extend through the female connecting member, a base section having a first side and a second side, a first pair of corners on the first side defining a first longitudinal recess along the first side between the first pair of corners, and a second pair of corners on the second side defining a second longitudinal recess along the second side between the second pair of corners;

wherein the pin is fitted inside the slot of the male connecting member when the first and second panels are connected along their vertical edges, the pin operating to align the first and second panels at the same vertical level with respect to each other.

7. The combination of claim 6, wherein the channel of the first panel comprises inner walls, and wherein only the four corners of the base section contact the inner walls of the channel when the base section slides inside the channel.

8. The combination of claim 6, wherein the sliding pin block further comprises a narrow upper section extending upwardly from the base section.

9. The combination of claim 6, wherein the slidable locking system further comprises a spring fixedly retained inside the channel of the first panel and coupled to the sliding pin block to bias the sliding pin block towards the vertical edge of the first panel.

10. In combination:

a first curved panel comprising a vertical edge, a female connecting member provided along the vertical edge, and a curved channel disposed transverse to the vertical edge;

a second panel comprising a vertical edge and a male connecting member provided along the vertical edge of the second panel and having a front surface, the male connecting member having a horizontally elongated slot provided on the front surface;

a slidable locking system for use in connecting the first and second panels, comprising a sliding pin block retained for sliding movement inside the channel of the first panel, the sliding pin block comprising a pin normally biased to extend through the female connecting member, a base section having a first side and a second side, a first pair of corners on the first side defining a first longitudinal recess along the first side between the first pair of corners, and a second pair of corners on the second side defining a second longitudinal recess along the second side between the second pair of corners; and wherein the pin is fitted inside the slot of the male connecting member when the first and second panels are connected along their vertical edges, the pin operating to align the first and second panels at the same vertical level with respect to each other.

11. The combination of claim 10, wherein the sliding pin block further comprises:

a narrow upper section extending upwardly from the base section.

12. The combination of claim 11, wherein the channel of the first panel comprises inner walls, and wherein only the four corners of the base section contact the inner walls of the channel when the base section slides inside the channel.

13. A sliding pin block for use in vertical aligning two adjacent panels and adapted for sliding movement inside a channel of one of the panels, the sliding pin block comprising:

a base section having a first side and a second side, a first pair of corners on the first side defining a first longitudinal recess along the first side between the first pair of corners, and a second pair of corners on the second side defining a second longitudinal recess along the second side between the second pair of corners; and a narrow upper section extending upwardly from the base section.

14. In combination:

a first panel comprising a vertical edge, a female connecting member provided along the vertical edge, and a channel disposed transverse to the vertical edge;

a second panel comprising a vertical edge and a male connecting member provided along the vertical edge of the second panel, the male connecting member having a slot;

a third panel comprising a bottom edge, the third panel adapted to be positioned on top of the channel of the first panel;

a slidable locking system for use in connecting the first and second panels, comprising a sliding pin block retained for sliding movement inside the channel of the first panel, the sliding pin block comprising a pin normally biased to extend through the female connecting member, and an upper section that extends outside and above the channel of the first panel to align and support the bottom edge of the third panel; and wherein the pin is fitted inside the slot of the male connecting member when the first and second panels are connected along their vertical edges, the pin operating to align the first and second panels at the same vertical level with respect to each other.

15. The combination of claim 14, wherein the female connecting member comprises a linear channel extending along the vertical edge of the first panel, and the male connecting member comprises a leg extending from the vertical edge of the second panel, the leg having a front surface facing the first panel, and wherein the slot is provided on the front surface.

16. The combination of claim 15, wherein the leg is slidingly engaged in the linear channel of the female connecting member to connect the second panel to the first panel, and wherein the pin of the sliding pin block extends through the linear channel of the female connecting member and into the slot.

17. The combination of claim 16, wherein the sliding pin block is pressed rearwardly as the leg is slid into the linear channel of the female connecting member, and the sliding pin block is biased back into the linear channel and the pin guided into the slot when the pin is aligned at the same vertical level with the slot.

18. The combination of claim 17, wherein the leg comprises a ramped surface below the front surface, and wherein the ramped surface engages the pin and presses the pin and sliding pin block rearwardly as the leg slides downwardly in the linear channel.

19. The combination of claim 14, wherein the channel of the first panel, and the third panel, have a curved configuration.

20. The combination of claim 19, wherein the pin has a width, and the slot has a width that is greater than the width of the pin.

* * * * *